United States Patent [19]

Monteil

[11] Patent Number: 4,938,687

[45] Date of Patent: Jul. 3, 1990

[54] GAS COOKING APPARATUS WITH ROTARY BURNER AND ELECTRICAL IGNITION

[75] Inventor: Jean-Francois Monteil, Isles sur Suippes, France

[73] Assignee: Soremam S.N.C., Senlis Cedex, France

[21] Appl. No.: 413,221

[22] Filed: Sep. 27, 1989

[30] Foreign Application Priority Data

Sep. 28, 1988 [FR] France ..... 88 12780

[51] Int. Cl.[5] ..... F23Q 3/00

[52] U.S. Cl. ..... 431/264; 126/39 R

[58] Field of Search ..... 431/264, 266; 126/39 R, 126/39 E, 39 H, 39 L, 41 A

[56] References Cited

U.S. PATENT DOCUMENTS 2,646,788 7/1953 Locke et al. .

4,805,587 2/1989 Schweitzer ..... 126/39 L

FOREIGN PATENT DOCUMENTS 499220 8/1982 France .

*Primary Examiner*—Carroll B. Dority

*Attorney, Agent, or Firm*—Cushman, Darby & Cushman

[57] ABSTRACT

This invention relates to a gas cooking apparatus with a rotary burner and electrical ignition. The burner carrier (10) is inserted in the top of a rotating support (3) fitting onto a feed pipe (40) with a horizontal venturi, in relation to which it turns by means of a chain drive (53) and of a geared motor (50). The off-center burner (20) includes gas outlet nozzles over a sector of 280° only and distributed symmetrically in relation to a plane in which passes the burner carrier rotation axis (10) directed towards the outside of this burner carrier. The gas outlet ducts (21) of the burner (20) make an angle of 10° to 20°, upwards, in relation to the horizontal plane. The base of the off-center burner (20) includes radial ribs (22) distributed symmetrically over a sector identical to that of the gas outlet nozzles (21). The igniter is integral with the rotating support.

9 Claims, 5 Drawing Sheets

GAS COOKING APPARATUS WITH ROTARY BURNER AND ELECTRICAL IGNITION

BACKGROUND OF THE INVENTION

1. Field of the Invention

This invention relates to a gas cooking apparatus with a rotary burner and electrical ignition.

Gastronomy demands that cooking of certain culinary preparations be obtained with a very low heat flow over a rather long period, or on the contrary, with a rather high heat flow over a rather short period, in order to obtain a very fast change in the corresponding preparation.

In order to solve the problems posed in the first case, gas cooking apparatus are generally fitted with a special burner, small in diameter, having therefore a small number of nozzles. However, if by means of this device, heat flow can be very much reduced, this flow is however limited to a small part only of the vessel bottom; thus there is a much faster transformation of materials in this area, near the bottom, that can bring about some local carbonization, which changes the taste of the preparation.

In the second case, the specific heat and the thermal conductivity of the mix that makes up the preparation, cause a temperature difference between the bottom and the upper part, producing a time gap in the transformation processes wanted between bottom and surface; which, in this case also, can cause an overheating of the materials that are near the bottom, and this overheating can produce: thickening, unwanted coloration, sticking to the bottom of the container, and, as an extreme effect, some carbonization modifying the taste, even to the point of making the preparation unfit for consumption.

In order to obviate these drawbacks, one would use traditionally, depending on the case, a heat spreader that was placed between the burner and the container bottom, or a simple water bath or one combined with an agitator, when cooking had to be run in a very progressive manner and when the preparation consistency allowed it, or a "hand trick" combining an alternating movement of the container held with one hand, above the burner, with agitation of the preparation with a spatula, in order to homogenize the mix transformation.

In order to remedy this situation and enable amateur cooks to achieve culinary preparations requiring somewhat delicate cooking, some manufacturers had the idea of fitting gas cooking devices with a rotary burner generating a rotating heat flow, with the aim to obtain a more regular and more homogeneous preparation.

2. Background Art

The state of technology is represented by devices described in the following patents:

U.S. Pat. No. 2,646,788, of which the object is a rotary burner made of a rotating gas bar, with a length corresponding to the maximum diameter of containers to be heated, with upward nozzles, evenly spaced, from the center towards the ends.

With such a burner, gas outlet nozzles can be easily obstructed, during an overflow, and the heat flow is larger around the center than at the periphery; this could only be imperfectly compensated by an irregular distribution of the nozzles, and/or by some progressivity in the nozzle diameter, from the center towards the ends of the bar. Besides, gas cooking apparatus as they are marketed today, are generally fitted with an electrical ignition device that would be rather difficult to combine with a rotary burner with rotating bar, and with outlet nozzles looking upwards, because the igniter would need, in this case, to be placed in the space left free between this bar and the bottom of the container.

French Patent No. 2.499.220 concerning a gas cooking apparatus, fitted with a rotating circular burner carrier, supporting a small off-center burner of wich the circular path is situated close to a fixed igniter. The burner carrier includes a chamber communicating with a tapered duct, making a venturi nozzle, installed in the drive shaft, the lower end of which communicates with a fixed chamber that includes, on its sides, the air inlets and, on the centerline, a gas inlet duct. The drive shaft of the burner carrier includes a collar fitted with an index finger allowing the burner orientation to be made to coincide with that of the burner on stoppage, in order to enable later electrical re-ignition to be made. With such an arrangement, the heat flow is much better spread than with the rotating bar burner examined hereabove. However this result is obtained through a combination of means relatively complex, which present certain drawbacks the main ones of which reside in the need for a rather accurate alignment of the rotating burner in relation to the fixed burner, and for a proper tightness between the lower end of the driving shaft and the mixing chamber, in an overall height incompatible with the incorporation with a heating plate in an integrated cooker, and in a bad combustion index resulting in a reduced efficiency and production of carbon monoxide.

SUMMARY OF THE INVENTION

It is the object of this invention to remedy those drawbacks. This invention, such as it is featured, solves the problem of making a burner rotate in relation to a feeding device of very low overall height, for which the ignition would require no alignment of the burner and of which the thermal efficiency would be optimized.

The gas cooking appliance, with a rotary burner and electrical ignition according to the invention has a main features that the burner carrier is inserted into the upper part of a rotating support which fits onto a feed pipe, in relation to which it turns by means of a chain drive or any similar means and of geared motor, and that the off-center burner has outlet gas nozzles only over a 280° sector distributed symmetrically in relation to a plane that includes the rotation axis of the burner carrier and the rotation axis of the assembly, directed towards the outside of this assembly, and that the gas outlet pipes of the burner form an angle alpha of 10° to 20°, upwards, in relation to the horizontal plane, and that the base of the off-center burner includes radial ribs, symmetrically distributed over a sector identical to that of the gas outlet nozzles and that the igniter is fixed to the rotating support.

The feed pipe of the off-center burner is made of an horizontal truncated duct and of a vertical cylindrical chamber, open at the top, fitted with fixing straps.

One construction in accordance with the invention features the off-center burner mounted in a semi-circular facing, of which the axis is the same as that of the off-center burner and of which the radius is arranged to provide a clearance E of 2 cm minimum between the off-center burner and the edge of the semi-circular facing.

In a preferred construction according to this invention, the burner carrier is the same part as the off-center burner, and the resulting burner head has a semi-circular sectorshaped rear part and an oblong front part, hollow in order to form an oblong chamber into which come out the outlet of the feed pipe chamber on the one hand, and the nozzles on the other hand.

In another construction in accordance with the invention, the off-center burner has an oblong shape and is fitted into the upper face of the rotating support so that the front part, which includes the gas nozzles, is tangential to the edge of the rotating support and that the rear part overhangs the outlet of the feed pipe chamber.

In either of these constructions, the rear part of the chamber of the oblong head of the off-center burner has a semi-spherical shape, with a radius corresponding to that of the outlet of the feed pipe chamber.

The igniter, fixed to the rotating support, is switched on by means of a finger, of which the end is placed at a short distance of a stationary and electrically conductive ring, connected to an electric pulse generator through a lead. Distance h between the igniter finger end and the conductive ring is designed so that an electric arc can spark at each pulse from the generator.

Advantages obtained through this invention consist mainly in that the feed pipe, the rotating support, and its driving device, can be housed into a very low space, compatible with integration in a fitted kitchen, that the heat flow is distributed in an optimum manner, that flames produced give the best efficiency/combustion ratio and that the burner ignition can be obtained without alignment.

Other features and advantages will appear in the following description of various ways of constructing a gas cooking apparatus with rotating burner driven by a chain and with electric ignition according to this invention, given as examples and not restrictive regarding the annexed drawings where:

DESCRIPTION OF THE PREFERRED EMBODIMENTS

Figure 1:
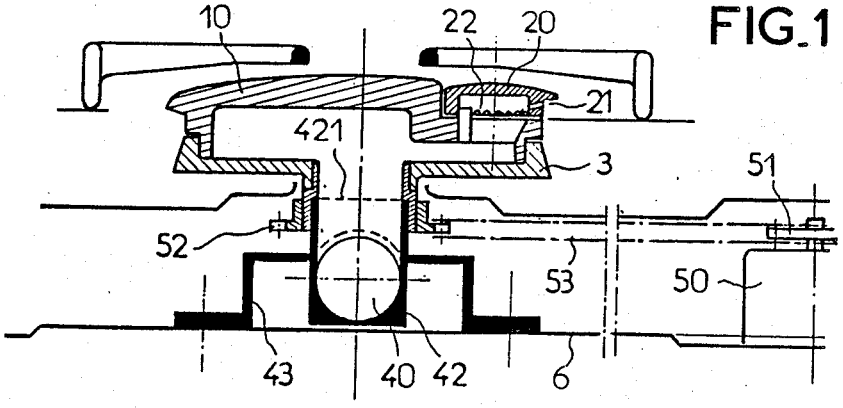
FIG. 1 represents a longitudinal cross-section of the cooking device.
Figure 2:
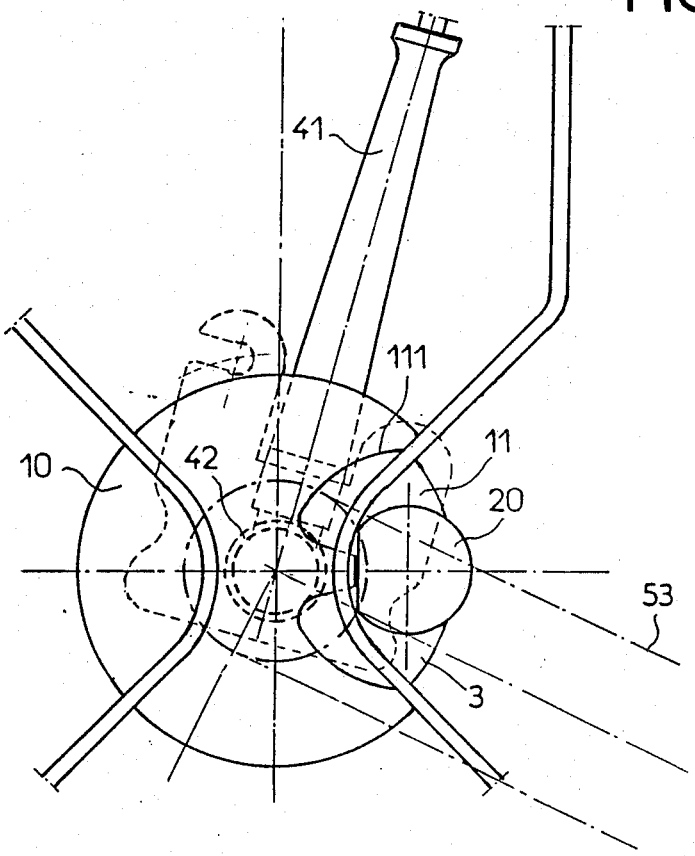
FIG. 2 represents a view from above of the cooking device.

FIGS. 1 to 4 represent therefore a cooking apparatus with rotary burner, according to this invention, including essentially a burner carrier 10 an off-center burner 20 with gas nozzles 21 and ribs for pilot flames 22, a rotary support 3 driven into rotation by a geared motor 50, through gears 51 and 52 and a chain 53, in relation to the end 421 of a feed pipe 40 made of a horizontal truncated duct 41 and of a vertical cylindrical chamber 42 fixed to the frame 6 of the apparatus by means of straps 43; the burner carrier 10 including a facing 11 of which the edge 111 is away from the burner by a distance E and the said burner being inserted by a height H with a play J. The gas nozzles 21 and the ribs for pilot flames 22 are distributed over a sector beta.

Figure 5:
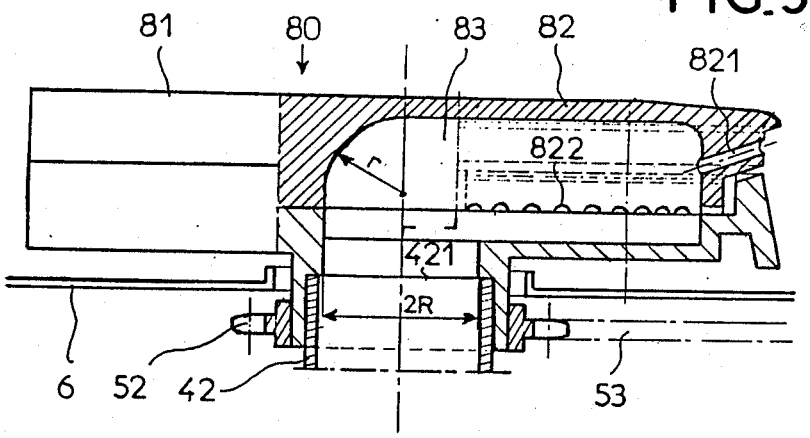
FIG. 5 represents a longitudinal cross-section of a rotary assembly, with burner and burner carrier merged into one burner head.
Figure 6:
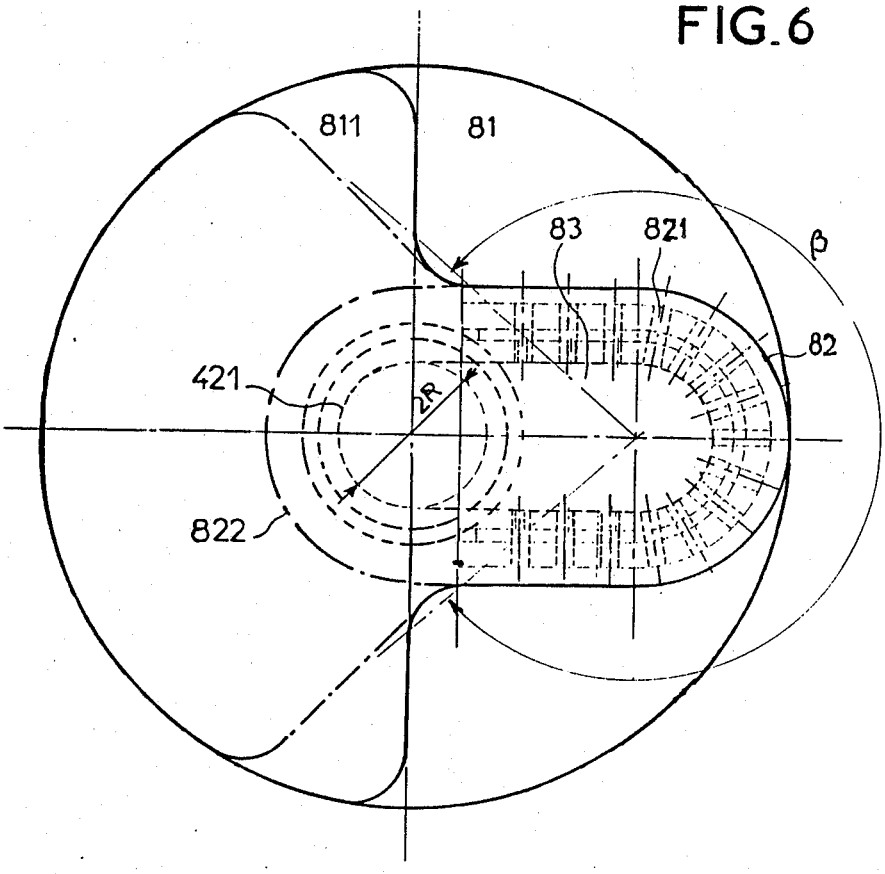
FIG. 6 represents a view from above of a rotary assembly, with burner and burner carrier merged into one burner head, with chain dotted lines showing the various alternatives of shape.

FIGS. 5 and 6 represent an alternative construction of the rotary burner cooking apparatus in which the burner head 80 includes a rear part, semi-circular or sector shaped 81 or 811 and a front oblong part 82, hollow along all its length in order to form a chamber 83 overhanging the nozzle 421 of the feed pipe 40 and ensuring circulation of gas towards nozzles 821 and ribs 822, distributed over a sector beta identical to that chosen in the main construction alternative.

Figure 7:
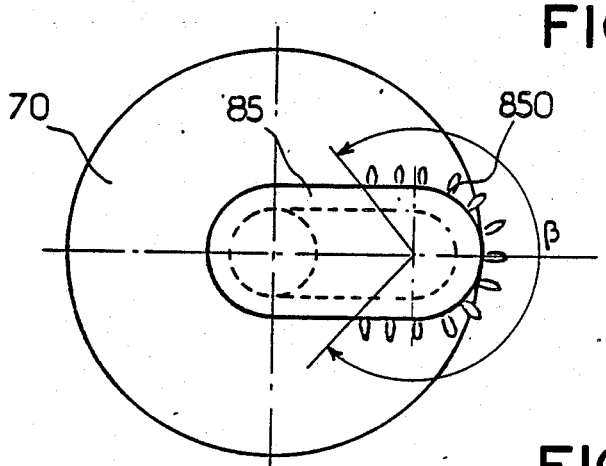
FIGS. 7, 8 and 9 represent three kinds of burners, with oblong shape, fitted into the top of the rotary support.
Figure 8:
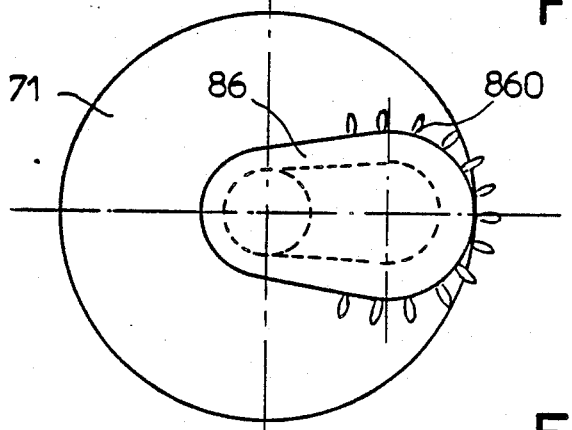
Figure 9:
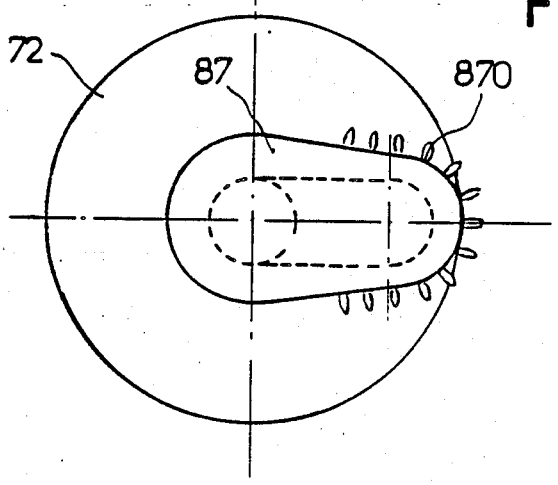

FIGS. 7 to 9 represent rotary supports 70 ,71 and 72 fitted respectively with oblong burners of different forms 85, 86 or 87, of which the nozzles 850, 860 or 870 are distributed over a sector beta identical to that used in the main construction example and the first alternative. The front part of the said oblong supports is tangential to the edge of the rotary support.

Figure 10:
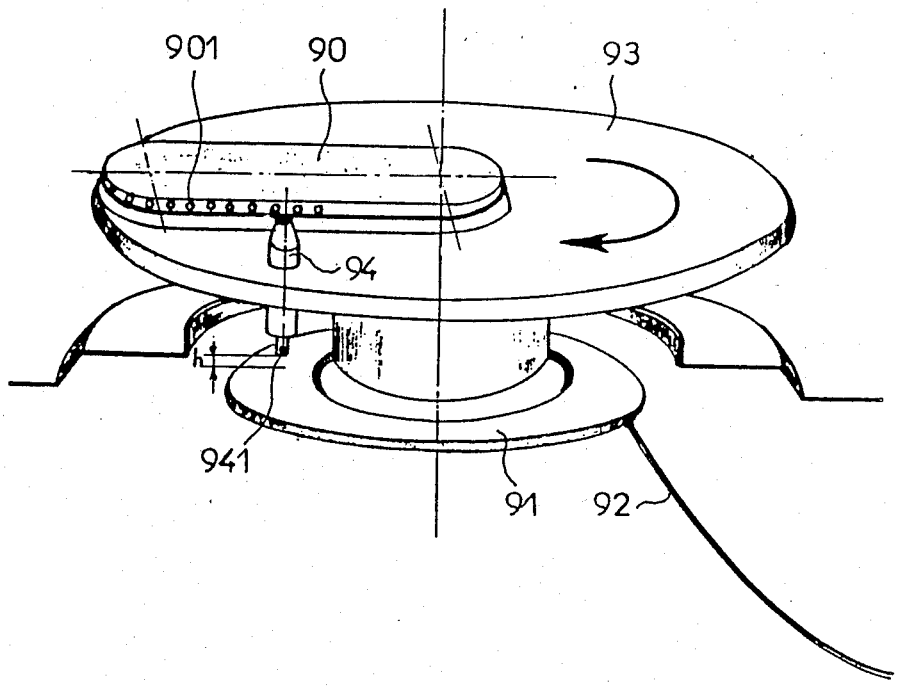
FIG. 10 represents a perspective view of a rotary support, with oblong shape removable burner, fitted with the ignition device.

The ignition device represented on FIG. 10 is essentially made of a rotary plate/burner-carrier assembly 93 supporting an off-center burner 90 that includes outlet nozzles 901 near which has been positioned, in the rotary assembly 93, an igniter 94, with finger 941, the end of which is situated at a distance h of a fixed conductor ring 91, connected through a lead 92 to an electrical pulse generator (not shown).

If one now examines in more detail FIGS. 1 to 4, one notices that the horizontal position of the venturi 41 and the 90° deflection, upwards, of the outlet of this venturi through a cylindrical chamber 42 open at its top, combined to the use of the upper edge of this chamber 42 as a pivot for the rotation of the rotary support 3 and with the drive of this support by a geared motor 50 arranged in a corner of the frame by means of a gear system 51 and 52 and chain 53, enabling a large reduction of the assembly height to be made, making it thus possible to present this cooking apparatus in the form of a hot plate that can therefore be installed over another home appliance in a fitted kitchen.

Figure 3:
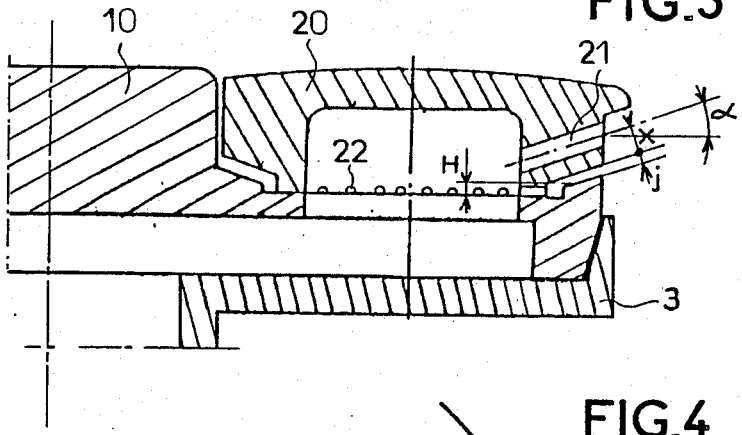
FIG. 3 represents a partial longitudinal cross-section, at burner level, of the rotary assembly.
Figure 4:
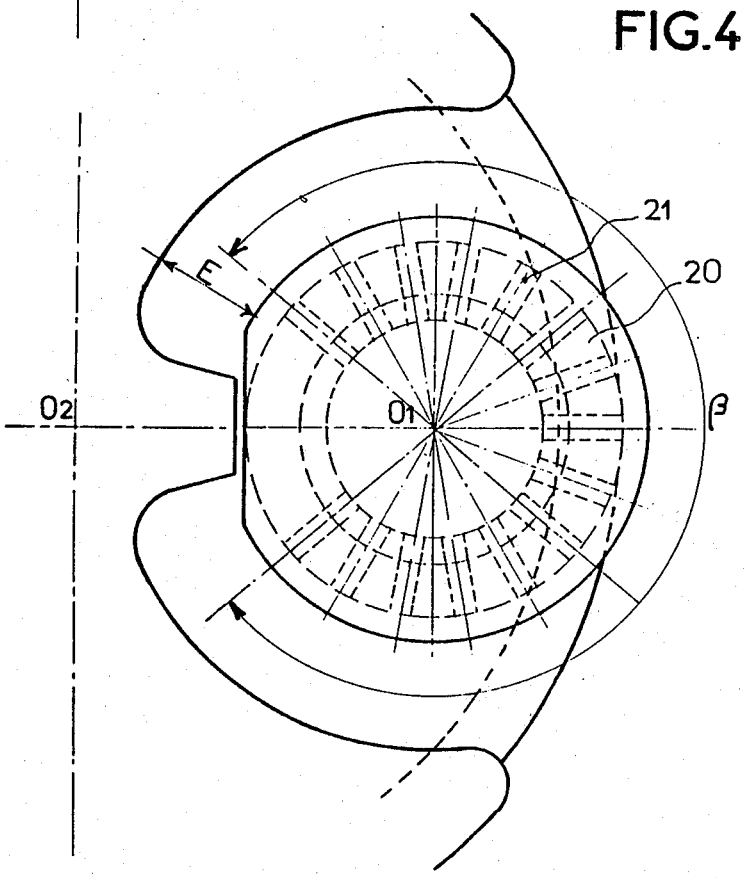
FIG. 4 represents a partial view from above, at burner level, of the rotary assembly.

When one studies in particular FIGS. 3 and 4 which concern the off-center burner 20 and its positioning, drive and feed devices, one notes first that the gas nozzles 21 and the radial ribs 22, for pilot flames, are only distributed over a sector beta of 280° situated near the front, in a symmetrical manner in relation to a vertical plane including axis 01 of the off-center burner 20 and rotation axis 02 of the assembly, that the outlet nozzles 21 of the burner 20 are sloped, towards the top, at an angle alpha of 10° to 20°, that the insert of the off-center burner 20 into the burner carrier 3 is limited to a height H and that a clearance J, by design, is arranged between the said burner 20 and the edge of the bedding with annular surfaces, inclined as well with the same angle alpha as the gas outlet nozzles 21 for the main flames and as a space E, of a value designed to obtain, in combination with the upward sloping of the nozzles 21, the best efficiency/combustion ratio, while avoiding production of carbon monoxide, which occurs when flames come and hit a wall. The neutralization of the flame production towards the center 02 over a sector of 80° allows, together with the other technical particularities analysed above, the the heat flow to be optimized when a container is being heated, by achieving a better distribution of this heat flow.

As an example, very good results are obtained with off-center burners of 38 mm diameter drilled with 15 gas nozzles of 2.3 mm diameter sloped with an angle of 10° upwards of which the axis is situated at a distance x=2.7 mm from the edge of the pilot flames annular path, of which the clearance J is equal to 1 mm, fed by 24 ribs 22 of 0.66 $mm^2$ section. The insert height H is then 2.3 mm.

However results remain good within the slope range alpha of the nozzles spanning from 10° to 20°, by changing the insert height H from 2.3 towards 1.5 mm. As for spacing E, to be kept between the burner and the edge 111 of the facing 11, it must be of at least 20 mm.

This last consideration enabled the invention to be implemented in accordance with the other two alternatives represented on FIGS. 5 and 6 on the one hand and 7 to 10 on the other hand.

Indeed, if one looks at FIGS. 5 and 6, one sees that, everything being otherwise equal with regard to the other parameters hereabove analysed, the shape of the facing into which the burner is placed, can be modified in order to facilitate the burner carrier manufacture on the one hand, and to facilitate subsequent maintenance on the other hand. Thus the arrangement in a single part, that we shall call "burner head" 80, of the off-center burner proper 82 and of the burner support 81 can be contemplated according to a simplified construction, the rear part of the burner head being possibly of semi-circular shape, such as the shape represented by 81 or sector shaped, such as represented by the chain-dotted line 811, even if having yet other shapes for aesthetical reasons. In this construction, the burner head 80 is hollow in its burner part 82 and central, so as to form a chamber 83 in which comes the gas flowing from the feed pipe 40, nozzles 821 and ribs 822 for pilot flames. In order to facilitate flowing of gas the part of chamber 83 overhanging outlet 421 of the feed chamber 42 is shaped as a quarter of a sphere with a radius r corresponding to the radius R of the outlet of feed chamber 42. As it has been already said above, all the other parameters are kept in the same proportions.

According to a way of construction even further simplified, the off-center burner has an oblong shape such as that completed by the chain dotted line 822 on FIG. 6 and shown in FIGS. 7 to 10. In this case, the burner head is limited to an oblong part 85, 86, 87 or 90 directly inserted in the rotary support 70, 71, 72 or 93, while sticking to the proportions given above. This construction presents the advantage of simplifying even further the construction of the assembly, of reducing height further and of facilitating subsequent care of surfaces subject to splashing.

When we now look at FIG. 10, one notices that the simplified construction described above lends itself to lodging in the rotating support 93, near the burner 90 with nozzles 901, a sparking plug 94 the end of the conductive part of which is situated at a distance h from a fixed conductive ring 91, of such value that there is no friction between the two parts. As the conductive ring 91 is connected through a flexible lead 92 to a pulse generator (not shown), one can easily understand that a re-ignition of the burner can be obtained whatever its direction and that all problems of alignment can be eliminated. The control system of the motor is the more simplified.

The apparatus in accordance with this invention is intended mainly to be fitted to gas hot plates for domestic use, but it could be used also in all fields in which transformation of liquid products demands certain precautions as to their transformation by heat, particularly in laboratories.

What is claimed is:

1. A gas cooking apparatus, with rotary burner and electical ignition, of which the rotary burner is made of a circular, rotary burner carrier (10) supporting an off-center burner (20) and an igniter, the burner carrier (10) nests into the upper part of a rotary support (3) which fits onto a feed pipe (40) in relation to which it rotates by means of a chain drive (5) and of a geared motor (6), in that the off-center burner (20) has gas nozzles only over a sector of 280° distributed in a symmetrical manner in relation to a plane in which is the axis of rotation of the burner carrier (10) directed towards the outside of the burner in that the gas nozzles (21) of the burner (20) make an angle alpha from 10° to 20°, upwards, in relation to the horizontal plane, in that the base of the off-center burner (20) includes radial ribs (22) distributed symmetrically over a sector identical to that of the nozzles (21).

2. A gas cooking apparatus according to claim 1 wherein the feed pipe (40) of the off-center burner (20) is made of a horizontal truncated duct (41) and of a cylindrical vertical chamber (42) open at the top, fitted with fixation straps (43).

3. A gas cooking apparatus according to claim 1 wherein the off-center burner (20) is mounted in a semi-circular facing (11) the axis of which is the same as that of the off-center burner (20) and the radius of which is designed to provide a minimum clearance of 2 cm between the off-center burner (20) and an edge (111) of the said semi-circular facing (11).

4. A gas cooking apparatus according to claim 1 wherein the burner carrier (10) and the off-center burner (20) are one single part.

5. A gas cooking apparatus according to claim 4 wherein, when the burner carrier is one with the off-center burner, the burner head (80) which is the result of this, includes a rear part half or semicircular (81) and an oblong front part (82) hollow in order to make up an oblong chamber (83) into which opens the outlet (421) of chamber (42) of the feed pipe (40) on the one hand, and the gas outlet nozzles (821) on the other hand.

6. A gas cooking apparatus according to claim 1 wherein the off-center burner (85, 86 or 87) is of oblong shape and is inserted directly into the upper face of the rotary support (70, 71, 72 or 93) to enable the front part, including gas outlet nozzles (850, 860, 870 or 901), to be tangential to the edge of the rotating support and the rear part to overhang the outlet (421) of chamber (42) of the feed pipe (40).

7. A gas cooking apparatus according to claim 5 wherein the rear part of the oblong chamber (83) of the burner head (80) has a curved shape with a radius (r) the same as that (R) of the outlet (421) of chamber (42) of the feed pipe (40).

8. A gas cooking apparatus according to claim 1 wherein the igniter (94) integrated with the rotating support (93) is switched on by means of a finger (941) the end of which is situated at a distance (h) of a fixed conductive ring (91) connected to an electric pulse generator through a lead (92).

9. A gas cooking apparatus according to claim 8 wherein distance (h) separating the finger (941) of igniter (94) from the fixed conductive ring (91) is designed so that an electric arc can spark at each pulse from the generator.

* * * * *